US009591910B2

(12) United States Patent
Kemp et al.

(10) Patent No.: US 9,591,910 B2
(45) Date of Patent: Mar. 14, 2017

(54) BACKPACK WITH TORSO LENGTH ADJUSTMENT MECHANISM

(71) Applicant: Thule IP AB, Malmö (SE)

(72) Inventors: Matthew Kemp, Sheffield (GB); Tim Fish, Sheffield (GB); Henrik Kax, Stockholm (SE)

(73) Assignee: THULE IP AB, Malmö (SE)

( * ) Notice: Subject to any disclaimer, the term of this patent is extended or adjusted under 35 U.S.C. 154(b) by 0 days.

(21) Appl. No.: 14/793,473

(22) Filed: Jul. 7, 2015

(65) Prior Publication Data

US 2016/0007720 A1 Jan. 14, 2016

(30) Foreign Application Priority Data

Jul. 9, 2014 (EP) ..... 14176397

(51) Int. Cl.
*A45F 3/04* (2006.01)
*A45F 3/08* (2006.01)
*A45F 3/12* (2006.01)

(52) U.S. Cl.
CPC ..... *A45F 3/047* (2013.01); *A45F 2003/125* (2013.01)

(58) Field of Classification Search
CPC ..... A45F 3/00; A45F 3/04; A45F 3/08; A45F 3/047
USPC ..... 224/634, 635, 636
See application file for complete search history.

(56) References Cited

U.S. PATENT DOCUMENTS 4,015,759 A * 4/1977 Dreissigacker ..... A45F 3/10 224/262
4,479,595 A * 10/1984 Opsal ..... A45F 3/047 224/630
5,004,135 A * 4/1991 Dufournet ..... A45F 3/047 224/262
5,632,429 A * 5/1997 Cantwell ..... A45C 13/30 224/264
5,725,139 A * 3/1998 Smith ..... A45F 3/02 224/631
5,904,282 A * 5/1999 Gleason ..... A45F 3/08 224/263

(Continued)

FOREIGN PATENT DOCUMENTS

DE 199 32 498 A1 2/2001
DE 199 32 499 A1 2/2001
EP 1 602 299 A1 12/2005

*Primary Examiner* — Brian D Nash
(74) *Attorney, Agent, or Firm* — Sterne, Kessler, Goldstein & Fox P.L.L.C.

(57) ABSTRACT

A backpack with a torso length adjustment mechanism is provided. The backpack includes a holder fixedly connected to a bag, a mesh back support having a back mesh contactable to the back of the user and a supporting element for spacedly supporting the back mesh on the holder. The backpack includes a shoulder strap length adjusting mechanism having a force transmitting element for transmitting a force from the holder to the shoulder straps of the backpack. The force transmitting element is lockably movable on the holder between a first position in which a size of the shoulder straps is the largest and a second position in which the size of the shoulder straps is the smallest. The shoulder strap length adjusting mechanism includes a locking mechanism at the holder for releasably locking a movement of the force transmitting element.

13 Claims, 4 Drawing Sheets

(56) References Cited

U.S. PATENT DOCUMENTS

| | | | | |
|---|---|---|---|---|
| 5,971,244 | A * | 10/1999 | Jaeger | A45F 3/08 224/632 |
| 6,179,188 | B1 * | 1/2001 | Gleason | A45F 3/047 224/262 |
| 6,607,108 | B2 * | 8/2003 | Mydans | A45F 3/04 224/630 |
| 6,626,342 | B1 * | 9/2003 | Gleason | A45F 3/08 224/633 |
| 7,232,048 | B2 * | 6/2007 | Le Gal | A45F 3/04 224/201 |
| 7,770,769 | B2 * | 8/2010 | Hurn | A45F 3/047 224/579 |
| 9,326,586 | B2 * | 5/2016 | Kax | A45F 3/04 |
| 2008/0217367 | A1 * | 9/2008 | Lillie | A45F 3/047 224/148.2 |
| 2009/0084821 | A1 * | 4/2009 | Lenzi | A45F 3/08 224/155 |
| 2014/0158736 | A1 * | 6/2014 | Ables | A45F 3/04 224/633 |
| 2014/0190054 | A1 * | 7/2014 | Ascano | F41C 33/007 42/71.01 |
| 2014/0203057 | A1 * | 7/2014 | Goryl | A41D 13/0012 224/576 |
| 2015/0173494 | A1 * | 6/2015 | Kax | A45F 3/04 224/627 |

* cited by examiner

BACKPACK WITH TORSO LENGTH ADJUSTMENT MECHANISM

BACKGROUND

The present invention relates to a backpack with a torso length adjustment mechanism.

Such a backpack typically comprises two shoulder straps connected to a bag of the backpack at different positions in order to fit the shoulder straps to the torso length of a user. The size adjustment of the shoulder straps can be of particular interest when the backpack is used by a user for the first time. It is however also of interest to be able to adjust the size of the backpack during wearing the same. In some situations, the user may want a bigger torso length setting compared to other situations. Furthermore, in case the correct size was not set correctly in the beginning and the user feels a need to adjust the length of the shoulder straps after some time in use, known systems demand that the user takes off the backpack and adjusts the shoulder straps to the desired size. This is however time consuming and annoying for the user.

Against this background, it is the object of the invention to provide a backpack having a torso length adjustment mechanism by which the user can easily adjust the torso length when carrying the bag.

SUMMARY

The present invention relates to a backpack with a torso length adjustment mechanism. The backpack comprises a holder fixedly connected to bag. The holder can comprise any shape which allows for holding the bag when the same is connected to the bag. In order to provide a fixed connection to the bag, the holder can be sewn on the bag or adhered thereto by an adhesive. Both kinds of connection allow a secure fixation of the holder on the bag.

Furthermore, the backpack comprises a mesh back support having a back mesh contactable to the bag of a user and a supporting element for spacedly supporting the back mesh on the holder. Accordingly, the mesh back support in either case comprises the latter two elements, that is a back mesh and a supporting element. The back mesh comprises a mesh structure allowing air to pass through the same. For that purpose, the back mesh can comprise openings which can have different shapes as long as it is possible for air to pass through the back mesh for ventilation purposes.

The back mesh is spacedly supported on the holder by means of the supporting element. The supporting element can be a frame structure for instance. Such a frame structure can be constructed so as to be connected to the holder in its middle portion and to hold the back mesh at its upper and lower portions respectively. Advantageously, the supporting element is constructed such that the back mesh is tensioned. In this connection, it is possible to preset the tensioning force of the back mesh such that the back mesh is able to rest against the back of a user when the backpack is worn. In other words the back mesh is tensioned such that it is able to follow the shape of the users back. By this, a comfortable support of the backpack on the user's back is achieved. Preferably, the supporting element comprises a curved structure and its ends are connected to each other by means of the back mesh which extends from one end, preferably the lower end, of the supporting element to the other end, preferably the upper end of the supporting element. In other words, the back mesh can be arranged on the supporting element such that there is no further contact between the back mesh and the supporting element other than at the ends of their supporting element. In this way, a middle portion of the supporting element is spaced from the back mesh. The middle portion of the supporting element can be fixed to the holder. By this, a fixed connection between the supporting element and the holder is achieved while the back mesh is arranged at a distance from the holder. The holder is fixedly connected to the bag so that a configuration is achieved in which the back mesh is spaced from the bag over a wide range of the construction. By this, a space is provided between the mesh and the holder which is accessible from the side.

The shoulder strap length adjusting mechanism comprises a force transmitting element for transmitting a force from the holder to the shoulder straps of the backpack. The force transmitting element is designed to transmit a force from the holder to the shoulder straps. For that purpose, the force transmitting element is arranged lockably moveable on the holder between a first position in which a size of the shoulder straps is the largest and a second position in which the size of the shoulder straps is smallest. The direction in which the force transmitting element is movable, can be a direction along the length of a user's back or in other words along the longitudinal extension direction of the back mesh. With such a configuration, the distance between the ends of each shoulder strap is made smaller or larger. In connection with the present definition of a movability of the force transmitting element between a first position and a second position, this definition shall not mean that only two positions of the force transmitting element are achievable. By contrast, the first position and the second position are to be understood as end positions and the force transmitting element can be lockable at various positions between both end positions.

In order to lock the movement of the force transmitting element at the different positions, the shoulder strap length adjustment mechanism further comprises a locking mechanism at the holder for releasably locking a relative movement of the force transmitting element and the holder with respect to each other. A relative movement can occur in different ways including a movement of the force transmitting element with respect to the holder, a movement of the holder with respect to the force transmitting element or a combined movement of both elements with respect to each other. Different configurations are possible in this connection. For example, the locking mechanism can be constructed so as to lock the movement of the force transmitting element with respect to the holder in one direction only. In practical use, it might be enough to provide a locking in one direction only. For example, upon normal use of the backpack, the weight of the bag via the holder exerts a force on the force transmitting element in the downward direction when the backpack is worn by a user. Thus, the locking mechanism must be able to lock at least a movement of the holder with respect to the force transmitting element in this direction. On the other hand, it is possible to provide a locking mechanism which releasably locks the relative movement between the force transmitting element and the holder in both directions. By this, it is possible to prevent any relative movement between the force transmitting element and the holder unless the locking mechanism is released. By providing a locking mechanism which releasably locks the movement of the force transmitting element with respect to the holder in both directions, an undesired relative movement between the holder and the force transmitting element and consequently of the bag with respect to the user can be prevented at all times.

Preferably, the locking mechanism comprises an operating section for releasing the locking, wherein the operating section is accessible through the space provided between the back mesh and the holder when the backpack is worn by the user. By rendering the operating section accessible through the space provided between the back mesh and the holder, the user can easily operate the operating section with his own hand while carrying the backpack. In order to operate the operating section, the user simply has to insert his hand into the space behind his back and to operate the operating section. By arranging the locking mechanism and the operating section on the holder, a natural posture of the wrist of the user's hand can be maintained and the operating section is easily operable. Accordingly, in this construction, the holder and the locking mechanism can be arranged so as to face the back mesh and consequently the user's back when the backpack is worn. Accordingly, a simple construction is achieved which allows the user to unlock the locking mechanism for a shoulder strap length adjustment while carrying the back pack.

Preferably, the locking mechanism comprises a latching portion engageable with an engagement portion of the force transmitting element and a gripping portion for pulling or holding the engagement portion. Accordingly, a ratchet type connection can be provided by interaction of the latching portion and the engagement portion of the force transmitting element.

For example, the latching portion can be arranged on the holder so as to be moveable with respect to the engagement portion. Preferably, the latching portion is provided rotatably moveable on the holder. The latching portion and the engagement portion are designed complementary in order to enable an engagement between the same. For instance, the latching portion can comprise a protrusion and the engagement portion can comprise a recess into which a protrusion is engageable.

The gripping portion can have different shapes as long as it is possible for the user to grip the engagement portion for pulling or holding the same. Preferably, the gripping portion is provided at an end of the engagement portion, preferably the end of the engagement portion facing downwards when the user wears the backpack. By this, the gripping portion is provided so as to be accessible through the space provided between the back mesh and the holder. Thus, in a configuration in which the gripping portion is provided at the lower end of the engagement portion, the gripping portion is provided below the latching portion.

According to a preferable embodiment of the present subject matter, the gripping portion is a loop fixed on the engagement portion. The loop can be made of a fabric and fixedly mounted at the bottom of the engagement portion. On the other hand, the loop can be formed by providing an opening in an end portion of the engagement portion. In this case, the loop is integrally formed with the engagement portion.

Preferably, the engagement portion comprises a strip with a locking profile. The locking profile can be a toothed profile. The toothed profile can be provided over the entire width of the strip and the latching portion can be correspondingly formed so as to engage with the toothed profile. The latching portion can be constructed to engage with multiple teeth at the same time. This has the beneficial effect that a higher load can be transferred to the force transmitting element via the locking profile. The toothed profile or locking profile can have the same orientation over substantially the entire width of the engagement portion. With such a profile, it is possible to releasably lock the force transmitting element in one direction. On the other hand, it is possible to provide two portions over the width of the engagement portion in which the toothed profile is oriented in opposite direction. By using a corresponding latching portion, it is possible to releasably lock a movement of the force transmitting element in both directions.

In order to engage with the engagement portion, the latching portion can comprise a locking latch releasably engageable with the locking profile. This locking latch is operable from a lock condition to a release condition. When the locking latch is in the lock condition, a movability of the force transmitting element is restricted at least towards the first position. As already mentioned before, the first position is the position in which the size of the shoulder straps is the largest. By this, the locking mechanism prevents a movement of the force transmitting element in the upward direction, or in other words, a movement of the holder in the downward direction.

In order to provide a self-locking function, the locking latch can be mounted so as to be urged towards the engagement portion. For that, a spring element can be provided urging the locking latch towards the engagement portion. By this, an engagement is effected by means of an urging force and the engagement is release upon operation of the operating section only. In this connection, by using a corresponding locking profile, it is possible to provide an arrangement in which, by moving or pulling the engagement portion in a downward direction, the locking latch rides over the locking profile and enables a movement of the force transmitting element in the downward direction, that is towards the second position. In case two opposite oriented locking profiles are provided on the engagement portion, a movement in each direction is prevented as long as the locking latch is engaged with the profile.

According to a preferable embodiment of the present subject matter, the force transmitting element comprises a shoulder strap attachment means for attaching end portions of the shoulder straps directly on the force transmitting element. The shoulder strap attachment means can have any configuration as long as it is possible to connect the shoulder straps with the force transmitting element and can be formed integrally with the force transmitting element or can be a separate element of the force transmitting element. The shoulder strap attachment means can be a bar-like member or portion extending cross to the extension direction of the engaging portion. In this case, the bar-like member and engaging portion can be regarded as main parts of the force transmitting element. It is also possible to provide openings in the force transmitting element through which ends of the shoulder straps can be passed and fixed thereto. In this case, the shoulder strap attachment means is realized by a portion of the force transmitting element in which the openings are formed. In case the shoulder strap attachment means comprises a bar-like member, the shoulder straps to the force transmitting element can be connected to the same by screwing or bonding them to the bar-like member. As an alternative, it is possible to provide a hook and loop fastener as shoulder strap attachment means. In this case, loops can be provided on the end portions of the shoulder straps which can be clipped to hooks provided on the force transmitting element. The force transmitting element can comprise a T-shape having a horizontal portion to which the end portions of the shoulder straps can be mounted next to each other. The bar-like member as described above can form the horizontal portion. In this configuration the engagement portion of the force transmitting element can extend from the middle of the horizontal portion of the force transmitting element in a direction substantially perpendicular to the horizontal portion of the force transmitting element.

Preferably, the backpack further comprises a connecting portion fixedly connecting the end portions of the shoulder straps at least at a predetermined distance from the shoulder strap attachment means. The connecting portion can extend substantially parallel to the shoulder strap attachment means which in turn extends in a substantially horizontal direction when the backpack is worn by a user. In other words, the connecting portion extends substantially perpendicular to the extension direction of the engaging portion of the force transmitting element. By connecting the shoulder straps by means of the connecting portion, it is possible to provide a stability of the shoulder straps when the force transmitting element and the shoulder straps are in the first position. In other words, when the shoulder straps are in a larger setting, the connecting portion prevents the shoulder straps from being movable away from each other too easily Preferably, the predetermined distance substantially corresponds to a movement distance of the force transmitting member between the first position and the second position. With such an arrangement, it is possible to define a gap which is limited by the connecting portion, the end portions of the shoulder straps and the shoulder strap attachment means. Such a gap can be used for guiding purposes. For example, it is possible to fix the mesh on the bag in the position of the gap. In other words, it is possible to provide a connection between bag and mesh in the gap. In such a configuration, the end portions of the shoulder straps pass the connection of the mesh on opposite sides of the connection. Alternatively, it is possible to provide two openings in the back mesh comprising a shape corresponding to the end portions of the shoulder straps. Accordingly, a construction is achieved in which a portion of the back mesh or a connection connecting the back mesh with the bag is arranged or provided in the gap and can function as a stop determining the first position and the second position of the force transmitting element and the shoulder straps. For example, when the force transmitting element and the shoulder straps are placed in the first position corresponding to the shoulder straps having the largest size, the upper portion of the force transmitting element, for example the shoulder strap attachment means, can be in contact with the back mesh or connection provided in the gap. On the contrary, when the force transmitting element and the shoulder straps are in the second position corresponding to the shoulder straps having the smallest size, the connecting portion connecting the shoulder straps can be in abutment with the back mesh or connection provided in the gap. Consequently, as the predetermined distance substantially corresponds to a movement distance of the force transmitting member between the first position and the second position, it is possible to predefine the first position and the second position.

According to a preferable embodiment of the present subject matter, the connecting portion extends in a direction substantially perpendicular to the movement direction of the force transmitting element and preferably comprises a handle portion. Accordingly, the connecting portion can itself at least partially formed as handle portion or can comprise an additional element forming the handle portion. For example, it is possible to sew a fabric to the shoulder straps. This fabric can function as the connecting portion and can furthermore be used as a handle. On the other hand, it is possible to provide a different connecting portion and to fix an additional handle portion on the connecting portion. It is beneficial if a connecting portion comprises a handle portion as such a configuration allows the user to grab the handle portion and pull the shoulder straps and the force transmitting element towards the first position when the backpack is not worn. Consequently, an easy and reliable adjustment of the torso length of the backpack is possible.

In a preferable embodiment of the present subject matter, the connecting portion comprises a fabric sewn to the shoulder straps or the connecting portion is integrally formed with the first and second shoulder straps. In case the connecting portion is integrally formed with the first and second shoulder straps, the wearing comfort for the user can be enhanced since the connecting port is basically made of the same material as the shoulder straps. Usually, the shoulder straps are cushioned and such a configuration is also beneficial for the connecting portion. This is especially important in case the connecting portion is provided such that it comes into contact with the back or neck of the user which, in some configurations, can be the case when the shoulder straps are in the largest setting. Therefore, in case the connecting portion is able to get in contact with the back or the neck of a user, an integrally formed cushioned portion as connecting portion is much more comfortable.

In a further preferable embodiment of the present subject matter, the holder comprises a plate. This has the advantage that the connection between the bag and the holder is provided over a larger area. Accordingly, forces transferred from the bag to the holder are distributed in a better way. Preferably, the plate is made of hard plastic. Using plastic as the material for the plate reduces the weight of the holder. Preferably, the plate is sewn onto the rear portion of the bag. With rear portion of the bag, the side of the bag which faces the mesh or the back of the user when the backpack is worn is meant. Consequently, a construction is achieved in which the bag is supported on the holder and the shoulder strap length adjusting mechanism is connected to the holder.

DETAILED DESCRIPTION

In the following, an embodiment of the present subject matter will be explained based on the drawings. It is noticed that the drawings show a specific embodiment as explained below and further alternative modifications as specified in the description are at least in part not illustrated therein. Furthermore, same reference signs used in the figures denote same components.

Figure 1:
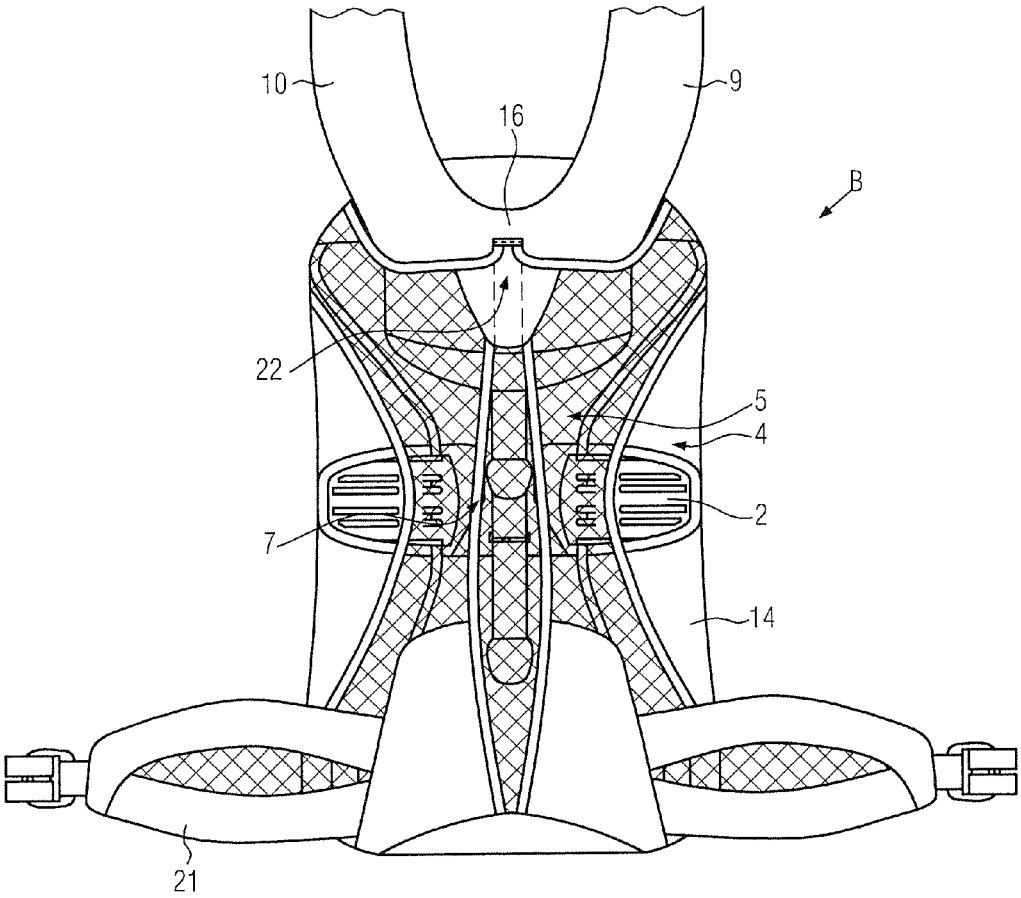
FIG. 1 shows a rear view of a backpack according to the present invention with the shoulder straps adjusted to small size.

FIG. 1 shows a backpack B with a torso length adjustment mechanism. The backpack B comprises a holder 2 fixedly connected to a bag 14. In the present embodiment, the holder 2 is sewn to the rear portion of the bag 14 and extends substantially over the entire width of the backpack B.

As it is further shown in FIG. 1, the backpack comprises two shoulder straps 9, 10 and a hip belt 21. The load carried in the bag 14 is transferred to the shoulder straps 9, 10 and the hip belt 21 in order to distribute the load on the shoulders and the hips of a user. The backpack B further comprises a back mesh 5 forming a supporting area for the user's back.

The back mesh 5 extends in a longitudinal direction of the backpack B from a lower side of the backpack B where the hip belt 21 is provided to an upper side of the backpack where the upper ends of the shoulder straps 9, 10 are provided.

In order to adjust the length of the shoulder straps 9, 10, the backpack B comprises a shoulder strap length adjusting mechanism 7 provided between the rear side of the bag 14 and the back mesh 5. The shoulder strap length adjusting mechanism 7 will be described later in detail with reference to FIG. 4.

As it is shown in FIG. 1, the shoulder straps 9, 10 are connected to each other by means of a connecting portion 16 which substantially horizontally extends from one shoulder strap to the other. The connecting portion 16 shown in FIG. 1 is arranged next to a connection or fixation portion 22 provided between end portions 9*a*, 10*a* of the shoulder straps 9, 10 and fixedly connected to the rear side of the bag 14. The fixation portion 22 can function as a stop and is provided in a gap defined by the connecting portion 16, end portions 9*a*, 10*a* of the shoulder straps and force transmitting element 8 described later. The gap is indicated in FIG. 1 with dashed lines and is also shown in FIGS. 2 and 4.

Figure 2:
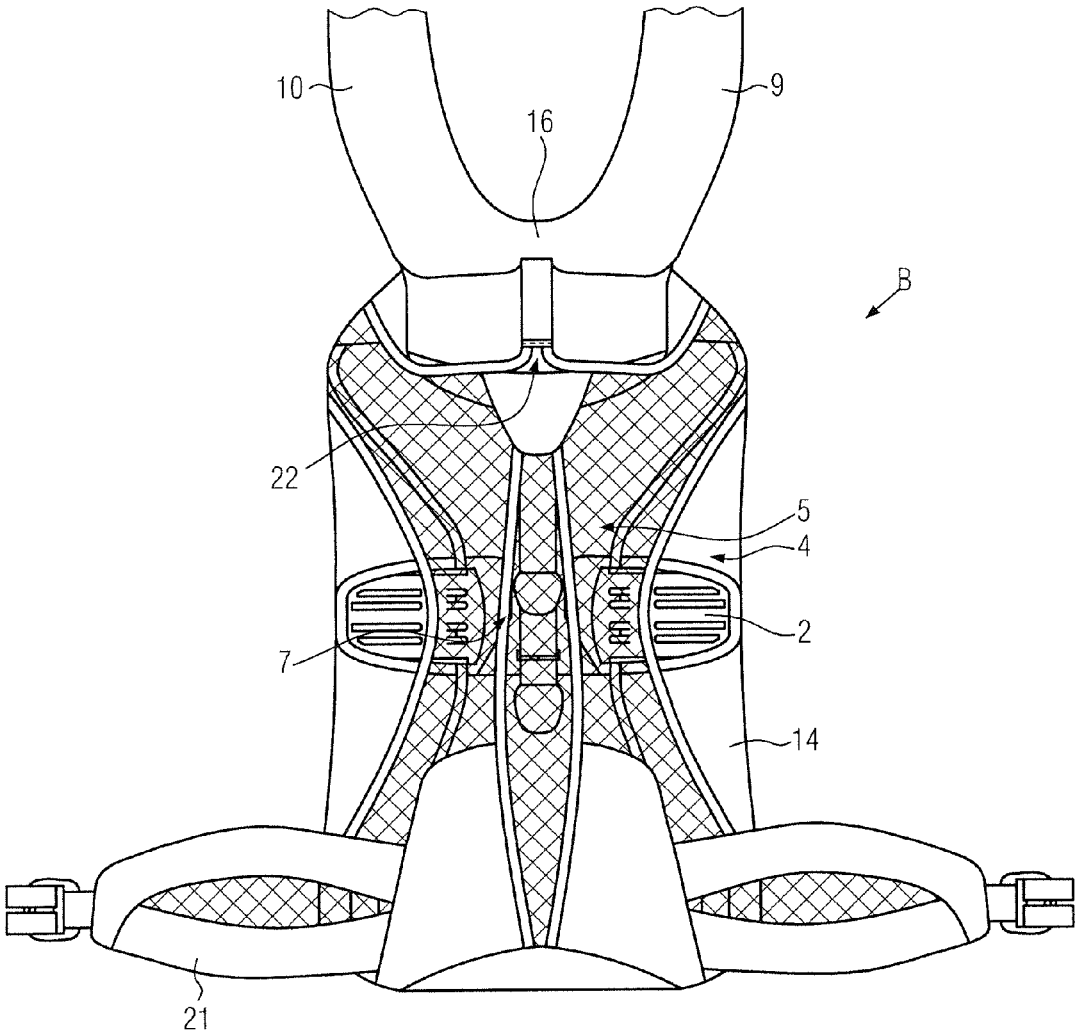
FIG. 2 shows a rear view of the backpack shown in FIG. 1 with the shoulder straps being set at large size.

As it is directly obvious by comparison of FIG. 1 with FIG. 2, FIG. 1 shows a state in which the connecting portion 16 is arranged next to the connection or fixation portion 22 and therefore the shoulder straps 9, 10 are at a position in which the size of the shoulder straps is set to small. By contrast, FIG. 2 shows the state in which the connecting portion 16 of the shoulder straps 9, 10 is arranged at a predetermined distance from the connection or fixation portion 22. Consequently, in this position, the shoulder straps 9, 10 are set at a large setting.

Figure 3:
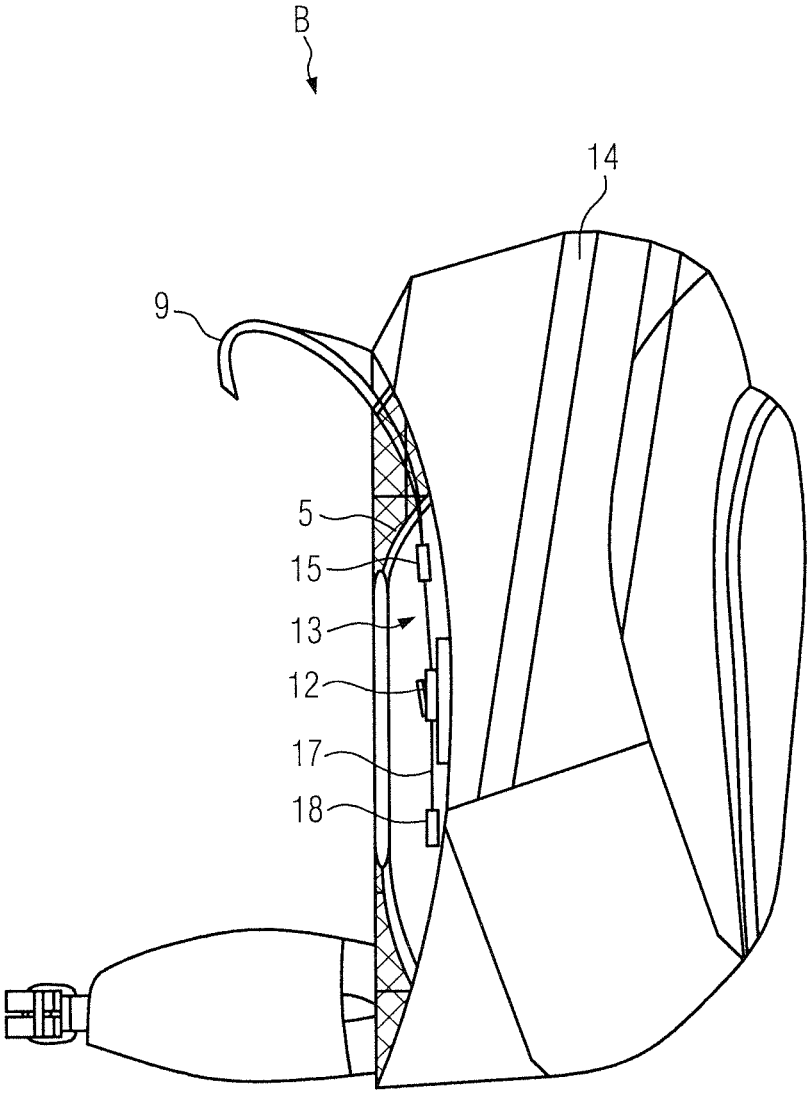
FIG. 3 shows a side view of the backpack.

FIG. 3 shows a side view of the backpack B. As it is shown in FIG. 3, the back mesh 5 is tensioned such that a certain distance is provided between the rear portion of the bag 14 and the back mesh 5. Thus, a space 13 is formed between the back mesh 5 and the bag 14. This construction enables a good air ventilation in order to prevent perspiration when carrying the backpack B. The holder 2 is fixedly mounted on the rear side of the bag 14 facing the back mesh 5. The function of the holder 2 will be explained in detail with reference to FIG. 4.

Figure 4:
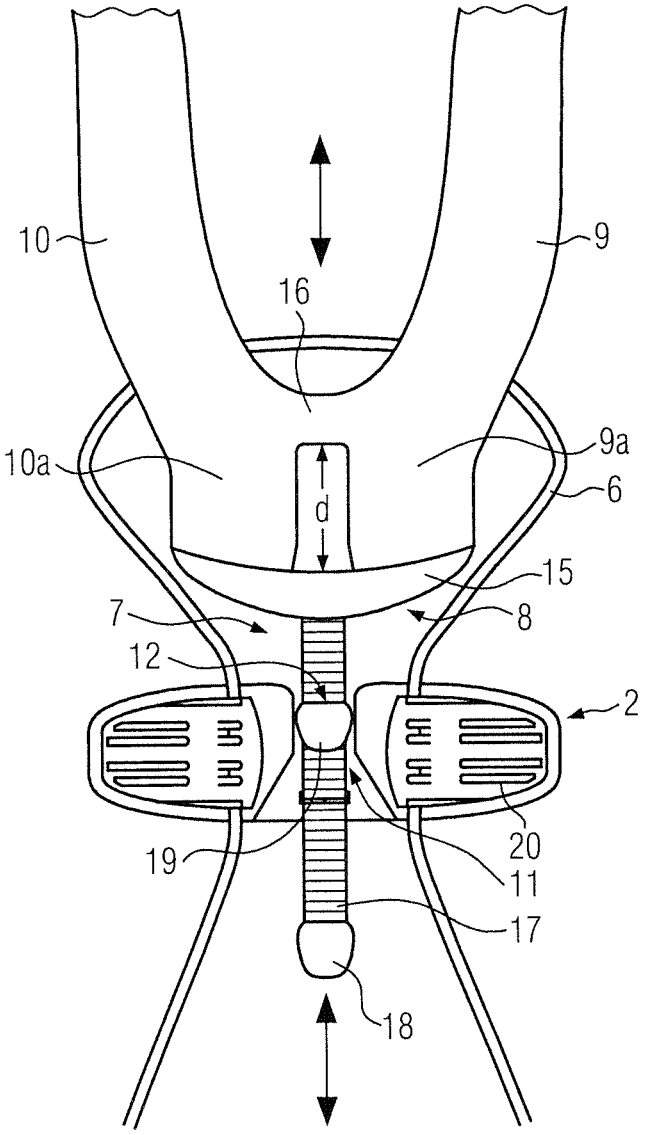
FIG. 4 shows a shoulder strap length adjusting mechanism.

FIG. 4 shows the shoulder strap length adjusting mechanism 7 as well as the holder 2 and a frame element 6 on which the back mesh 5 is mounted. The frame element 6 is fixedly connected to the holder 2. The shoulder strap length adjusting mechanism 7 comprises a force transmitting element 8 for transmitting a force from the holder 2 to the shoulder straps 9, 10 of the backpack. The force transmitting element 8 comprises an engagement portion 17 and shoulder strap attachment means 15. The engagement portion 17 comprises a strip with a locking profile which in the present case is a toothed profile. The shoulder strap attachment means 15 is a plate shaped member connected to a first end of the engagement portion 17 and extending substantially perpendicular to the extension direction of the engagement portion 17. Consequently the force transmitting element 8 comprises a T-shape. A gripping portion 18 is provided at an end of the engagement portion 17 opposite to the end where the shoulder strap attachment means 15 is connected to the engagement portion. Accordingly, with respect to the overall structure of the backpack B, the shoulder strap attachment means 15 is provided at the upper end of the engagement portion 17 and the gripping portion 18 is provided at the lower end of the engagement portion 17.

The locking mechanism 11 is fixedly mounted on the holder 2, more precisely on a plate 20 of the holder. The plate 20 is preferably made of hard plastic and is sewn onto the rear portion of the bag 14. The locking mechanism 11 comprises a latching portion engageable with the toothed profile of the engagement portion 17. Although not shown in detail, the latching portion is rotatably mounted about a rotational axis which extends in parallel to the extension direction of the plate 20 at a predetermined distance from the plate 20 defining a space between the latching portion and the plate 20 through which the engagement portion 17, more precisely the strip comprising the toothed profile, is passed. The latching portion comprises a locking latch 19 which is operable from a lock condition to a release condition. In the present embodiment, the lock condition is achieved by pre-tensioning the locking latch 19 by means of a spring element (not shown) urging the locking latch towards the lock condition in which teeth formed correspondingly on the locking latch engage with the toothed profile of the strip. The locking latch is arranged in such a manner that a movement of the plate 20 with respect to the engagement portion 17 is allowed in the upward direction and is restricted in the downward direction. Accordingly, the locking latch 19 and the engagement portion 17 together form a ratchet type locking system allowing a movement of the holder with respect to the engagement portion 17 in one direction and restricting the movement in the opposite direction when the operating section 12 is not operated.

In order to effect a movement of the plate 20 with respect to the engagement portion 17 in the downward direction, the user has to operate the operating section 12 thereby releasing the engagement of the locking latch 19 with the locking profile on the engagement portion 17. In order to provide an easy access for the user, the locking mechanism 11 together with the operating section 12 is provided on the plate member 20 such that the operating section 12 faces the back mesh 5 and is accessible through the space 13 provided between the back mesh 5 and the holder 2 when the backpack is worn by the user. Accordingly, the construction allows the user to easily adjust the length of the shoulder straps to his torso length while carrying the backpack. In order to do this, the user can simply operate the operating section 12 thereby releasing the locking between the engagement portion 17 and the locking latch 19 leading to a movement of the plate 20 together with the bag 14 in the downward direction corresponding to a setting of the shoulder straps 9, 10 which is the largest. Now, in order to adjust the height of the bag 14 with respect to the back of the user, the user can simply grab the gripping portion 18 with one hand in order to prevent a movement of the engagement portion 17 and push the bag 14 from below with his other hand leading to a movement of the bag 14 together with the plate 20 with respect to the engagement portion 17 in the upward direction, i.e. in the direction towards a small setting of the shoulder straps 9, 10. As soon as a proper height of the bag 14 with respect to the back of the user is reached, the user simply stops pushing the bag 14 in the upward direction and the bag 14 will rest at the desired height.

Consequently, the present invention provides the advantage that the height position of the bag 14 with respect to the users back can be easily adjusted while carrying the backpack. The operating section 12 of the locking mechanism 11 is easily accessible by inserting the hand in the space 13 provided between the back mesh 5 and the holder 2 and the user does not have to unnaturally rotate his wrist in order to operate the operating section 12. Accordingly, a backpack with an enhanced torso length adjustment mechanism is provided.

The invention claimed is:

1. A backpack with a torso length adjustment mechanism, comprising:

a holder fixedly connected to a bag;

a mesh back support comprising a back mesh contactable to the back of a user and a supporting element for spacedly supporting said back mesh on said holder;

a shoulder strap length adjusting mechanism comprising a force transmitting element for transmitting a force from said holder to shoulder straps of said backpack, said force transmitting element being arranged lockably movable on said holder between a first position in which a size of said shoulder straps is the largest and a second position in which the size of said shoulder straps is the smallest; and a locking mechanism at said holder for releasably locking a movement of said force transmitting element, wherein said locking mechanism comprises an operating section for releasing said locking mechanism, said operating section being accessible through a space provided between said back mesh and said holder when the backpack is worn by said user, wherein said locking mechanism comprises a latching portion engageable with an engagement portion of said force transmitting element, and a gripping portion for pulling or holding said engagement portion, wherein said engagement portion comprises a strip with a toothed locking profile, and said latching portion comprises a locking latch releasable engageable with said locking profile, wherein said locking latch is operable from a lock condition to a release condition, wherein when said locking latch is in said lock condition, a movability of said force transmitting element is restricted at least towards said first position.

2. The backpack according to claim 1, wherein said gripping portion is a loop fixed on said engagement portion.

3. The backpack according to claim 1, wherein said force transmitting element comprises a shoulder strap attachment means for attaching end portions of said shoulder straps directly on said force transmitting element, said backpack further comprising a connecting portion fixedly connecting said end portions at least at a predetermined distance from said shoulder strap attachment means.

4. The backpack according to claim 3, wherein the predetermined distance substantially corresponds to a movement distance of the force transmitting member between said first position and said second position.

5. The backpack according to claim 3, wherein said connecting portion extends in a direction substantially perpendicular to the movement direction of said force transmitting element and comprises a handle portion.

6. The backpack according to claim 5, wherein said connecting portion comprises a fabric sewn to said shoulder straps or wherein said connecting portion is integrally formed with said first and second shoulder straps.

7. The backpack according to claim 1, wherein said holder comprises a plate made of hard plastic and sewn onto a rear portion of said bag.

8. The backpack according to claim 7, wherein the plate is movable with respect to the engagement portion in an upward direction and restricted in a downward direction.

9. The backpack according to claim 1, wherein the locking latch and the engagement portion are configured to form a ratchet type locking system.

10. The backpack according to claim 9, wherein the ratchet type locking system allows movement of the holder with respect to the engagement portion in a first direction and restricts movement of the holder with respect to the engagement portion in an opposite direction.

11. The backpack according to claim 1, wherein the locking latch comprises a spring element configured to pretension the locking latch.

12. The backpack according to claim 11, wherein the spring element is configured to move the locking latch towards the lock condition.

13. The backpack according to claim 1, wherein the first position is achieved by releasing the locking mechanism using the operating section and allowing the backpack to move in a downward direction, and wherein the second position is achieved by pulling the gripping and pushing the backpack in an upward direction.

* * * * *